United States Patent [19]

Miller

[11] 4,087,215

[45] May 2, 1978

[54] GEROTOR GEARSET DEVICE

[75] Inventor: Laurence Lockhart Miller, West Lafayette, Ind.

[73] Assignee: TRW Inc., Cleveland, Ohio

[21] Appl. No.: 706,131

[22] Filed: Jul. 16, 1976

[51] Int. Cl.[2] ..... F01C 1/02; F03C 3/00; F01C 5/04

[52] U.S. Cl. ..... 418/61 B; 418/156; 418/225

[58] Field of Search ..... 418/56, 61 B, 156, 157, 418/166, 171, 225

[56] References Cited

U.S. PATENT DOCUMENTS

| | | | |
|---|---|---|---|
| 2,725,013 | 11/1955 | Vlachos | 418/225 |
| 3,591,320 | 7/1971 | Woodling | 418/61 B |
| 3,598,509 | 8/1971 | Goff | 418/61 B |

*Primary Examiner*—John J. Vrablik

[57] ABSTRACT

A hydraulic device includes an internally toothed stator formed by a one-piece homogeneous body having a continuous inner wall defining a series of circumferentially spaced arcuate recesses each of which is dimensioned to receive a radially and circumferentially shiftable roller vane. The continuous inner wall further includes a series of radially oriented notches which are disposed between the arcuate recesses and which serve to make portions of the stator wall defining the arcuate recesses resiliently deflectable as a function of the forces applied to the rollers vanes. Further, the notches direct fluid flow to and from expanding and contracting fluid pockets defined between the roller vanes and the teeth of an externally toothed rotor located within the stator.

6 Claims, 6 Drawing Figures

GEROTOR GEARSET DEVICE

BACKGROUND OF THE INVENTION

This application relates to hydraulic devices of the type in which a series of expandable and contractable fluid pockets are defined between the intermeshing teeth of a gerotor gearset having an internally toothed stator and an externally toothed rotor adapted for relative orbital and rotational movement. It relates particularly to hydraulic devices of the type in which each internal tooth of the stator comprises a cylindrically shaped roller located in a recess of the stator, and which rollers rotate in their recesses and also perform a vaning function by engaging the teeth of the rotor to seal the high pressure zones of the device from the low pressure zones.

There are many known forms of hydraulic devices in which a series of expandable and contractable fluid pockets are formed between the intermeshing teeth of a gerotor gearset having an internally toothed stator whose teeth are formed by a series of cylindrical rollers located in recesses in the stator and which rotate and vane during operation of the device. The recesses and the cylindrical rollers are dimensioned such that the recesses provide rolling support for the rollers. U.S. Pat. No. 3,289,602 is typical of such devices.

The inner wall of the recesses and the outer walls of the rollers have smooth surface finishes and their dimensioning is such that a film of high pressure fluid is formed between them as the device operates. The film of high pressure fluid helps to seal the high pressure zone from the low pressure zone by applying a resultant force having a substantial radial component against the roller teeth of the stator to move and maintain rollers in sealing engagement with the rotor teeth. Also the forces on the roller cause the roller to shift circumferentially and provide a seal between the roller and the surface defining the recess in which the roller is located. This action of the roller is referred to as a vaning action. The film of high pressure fluid also serves to reduce wear between the rollers and stator by providing lubrication between the rollers and the stator.

It has been recognized that at high operating pressures there are high resultant non-radial forces exerted against the cylindrical rollers and that these resultant non-radial forces tend to destroy the film of high pressure fluid between the rollers and the wall of their respective recesses. This results in considerable direct contact between the rollers and the wall of their respective recesses. As a result wear and/or galling can occur. Further, rolling action of the roller may then cease, resulting in wear of the rotor teeth due to a rubbing contact with the roller.

There have been various suggestions for designing hydraulic devices of this type in a manner which serves to positively maintain high pressure fluid between the rollers and their recesses to promote the sealing action of the rollers and to help to reduce wear on the rollers and the recess walls. One such suggestion can be found in the disclosure of U.S. Pat. No. 3,915,603. In this patent each of the arcuate recesses is formed with a pair of additional recesses and each of the additional recesses receives a sealing member which is movable in the recess by pressures developed during operation of the device. The movement of the sealing member is intended to maintain a desired film of high pressure fluid between each roller member and its respective pocket.

The sealing member operates as a seal and not as a load carrying member to carry the load of the roller.

Another type of suggested device is designed to direct fluid to the areas between the rollers and the arcuate recesses as shown in U.S. Pat. No. 3,692,439. According to the disclosure of this patent high pressure fluid is diverted directly to the area between the rollers and the recesses for forcing the rollers into engagement with the teeth of the rotor. In positively diverting high pressure fluid for this purpose this device apparently sacrifices some degree of volumetric efficiency.

In U.S. Pat. Nos. 3,915,603 and 3,692,439 while provision is made for maintaining fluid in the recesses to shift the roller radially, the galling due to circumferential movement of the rollers can occur. Further, these structures are somewhat complicated and expensive and require a multiplicity of parts.

A suggestion to minimize galling of the roller and the stator recesses is shown in U.S. Pat. No. 3,460,481 in which the inner wall of each recess is provided with a lining such as Teflon. Here again this is a somewhat complicated and expensive structure.

SUMMARY OF THE PRESENT INVENTION

The present invention provides a new and improved hydraulic device of the type utilizing a gerotor gearset where the teeth of the internally toothed member are roller vanes. In accordance with the present invention, the rollers of the internally toothed member rotate during relative rotational and orbital movement of the internal (stator) and external (rotor) toothed members. Further, the roller vanes move generally into sealing contact with the rotor teeth to provide a seal between the rotor and stator and move generally circumferentially to provide a seal between the wall of the recess in which the roller is located and the roller. This provides a seal between the high and low pressure portions of the device. In accordance with the present invention the inner wall of the stator is constructed so that a fluid film is normally maintained between the roller and the surface defining the roller receiving recess.

More specifically, in accordance with the present invention the stator includes a one-piece homogeneous body having a continuous inner wall which defines a series of arcuate recesses each of which is dimensioned to receive a radially and circumferentially shiftable roller vane. The continuous inner wall further defines a series of radially oriented notches which are disposed between the arcuate recesses and which serve to make portions of the inner wall defining the arcuate recesses resiliently deflectable as a function of the forces applied to the rollers.

When high non-radial forces are applied to a roller vane to shift the roller vane radially and circumferentially in its recess, wall portions of the recess may deflect and a fluid film is normally maintained between the roller and the wall portions of the recess. As a result, through the addition of a notch a considerable reduction in wear is achieved between the roller and the recess, even at high operating pressures. This is obviously a substantial simplification as compared to the complicated and expensive structures in the art and referred to above.

A further feature of the present invention relates a commutation system provided for directing fluid flow to an from the expanding and contracting pockets in timed relationship to the relative orbital and rotational motion of the gearset elements and in a manner which is designed to provide high volumetric efficiency. A valve disc includes a radial face which abutts one axial side of the gearset elements and which is fixed to the externally toothed rotor and which orbits and rotates therewith relative to the internally toothed stator. The disc includes a number of pairs of fluid passages equal in number to the number of rotor teeth. One of each pair of fluid passages is in constant fluid communication with a source of high pressure fluid, and the other of the passages is in constant fluid communication with low pressure fluid. The pairs of fluid passages are disposed in a circular pattern which is dimensioned to bring portions of the passages into radial alignment with selected portions of the notches during selected rotational and orbital positions of the gearset elements. This allows efficient transition of a respective pocket from a high pressure zone to a low pressure zone and has the effect of providing the device with extremely high volumetric efficiency.

BRIEF DESCRIPTION OF THE DRAWINGS

Further objects and advantages of this invention will become further apparent from the following detailed description taken with reference to the accompanying drawings wherein.

DETAILED DESCRIPTION OF THE PREFERRED EMBODIMENT

Figure 1:
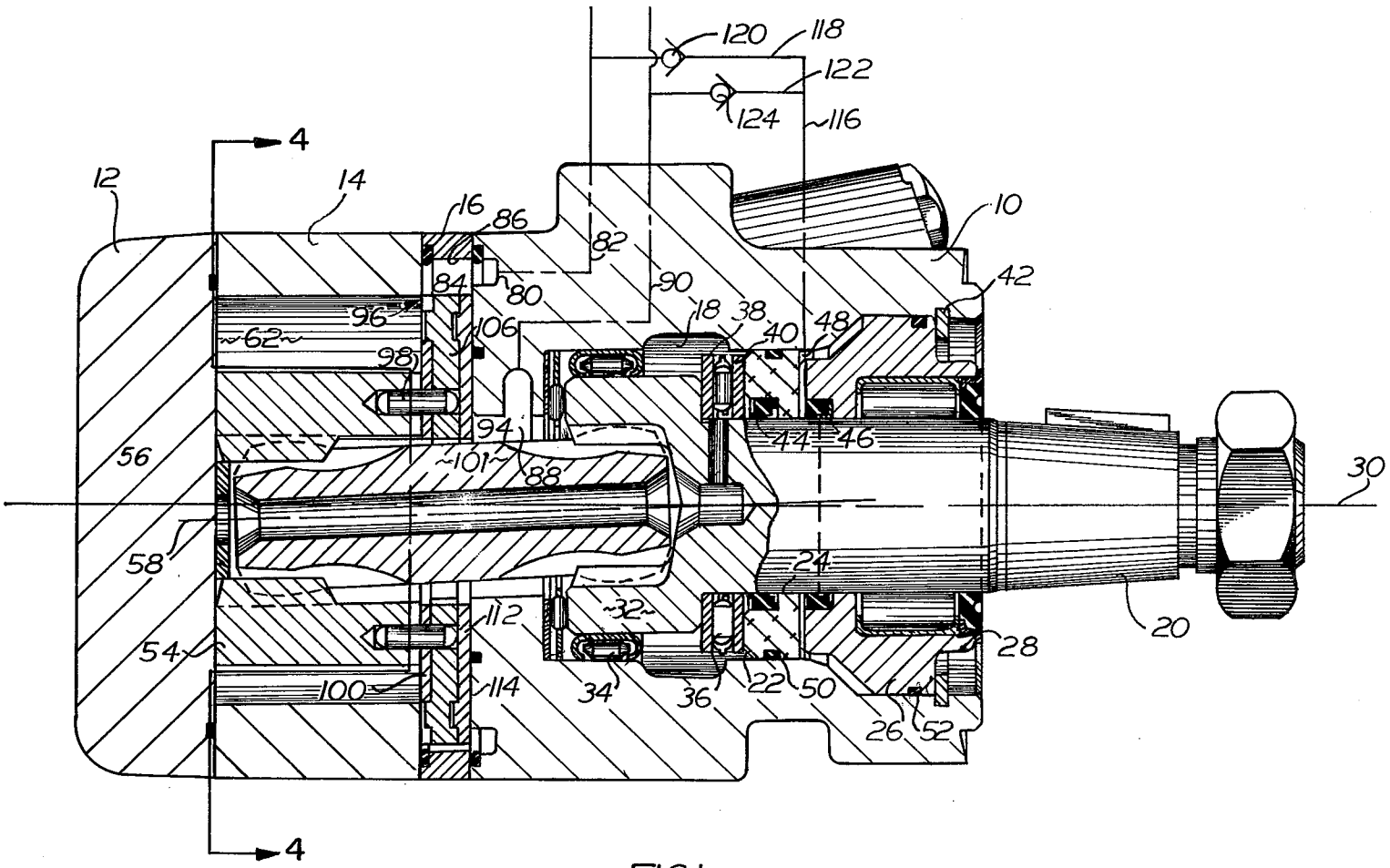
FIG. 1 is a longitudinal cross sectional view of a hydraulic device employing the principles of the present invention.

FIG. 1 illustrates a hydraulic device constructed in accordance with the present invention. The device of FIG. 1 can be used either as a pump or a motor and for illustration purposes it will be referred to hereinafter as a hydraulic motor. However, from the description which follows the manner in which the structural features of this invention can be used as a pump will become readily apparent to those of ordinary skill in the art.

In the illustrated embodiment of FIG. 1, the hydraulic motor includes a housing comprising housing members 10, 12 fixedly secured to each other by conventional means such as bolts, etc. (not shown). A stator plate 14 and an additional plate member 16 are disposed between the housing members 10, 12 and are also fixedly connected with the housing members 10, 12 in an axially aligned relationship.

Housing member 10 includes a central chamber 18 and an output shaft 20 is disposed partially within the chamber 18. A bearing member 22 is disposed within the chamber 18 and includes an inner wall 24 which provides a bearing support for a portion of the output shaft 20. An end closure member 26, also disposed within chamber 18, includes roller bearings 28 which rotatably journal the output shaft 20 for rotation about its central axis 30. The innermost end of the output shaft 20 includes an enlarged head 32 journaled for rotation about central axis 30 by means of axially extending roller bearings 34 and radially extending roller bearings 36. A series of thrust bearing disc member 38, 40 and 42 take up the axial forces generated during operation of the device.

A ring member 44 preferably formed either of Teflon or a combination of Teflon and an elastomeric member forms a dynamic seal against leakage of fluid between the shaft 20 and the member 22. Ring member 46, also formed of Teflon or a combination of Teflon and an elastomeric material forms a dynamic seal against leakage of fluid from a chamber 48 formed between insert member 22 and end closure member 26. Static seals are provided by O-rings 50, 52 and serve to further seal the central chamber 18 against leakage of fluid.

Rotation of the output shaft 20 is effected by the relative orbital and rotational movement of the intermeshing members of a gerotor gearset. In the illustrated embodiment the gerotor gearset includes an internally toothed stator which includes the stator plate 14 and an externally toothed rotor 54. The externally toothed rotor 54 has one less tooth than the stator and has a central axis 53 which is eccentrically disposed relative to the central axis 55 of the stator. During operation, the rotor 54 rotates about its axis and orbits about the central axis of the stator.

A wobble shaft 56 has a central axis 58 disposed at an angle with respect to central axis 30 of the output shaft and has a portion which is splined to the rotor 54 and which portion rotates and orbits with the rotor 54. Another portion of the wobble shaft 56 is splined to the enlarged head 32 of the output shaft 20 and serves to rotate the output shaft 20 about its central axis 30 as the rotor 54 orbits and rotates with respect to the stator.

The spline connections between the wobble shaft 56 and the rotor 54 and between the wobble shaft 56 and the output shaft 20 are preferably constructed in accordance with the disclosure of U.S. Pat. No. 3,606,601, the disclosure of which is incorporated herein by reference. Generally, the wobble shaft portion of the spline connection comprises between 50 and 60% of the circular pitch and is such that the loaded male teeth of the wobble shaft are subjected to compressive stresses and have pressure angles of less than 45°. Further details of this spline connection can be obtained from U.S. Pat. No. 3,606,601.

Figure 2:
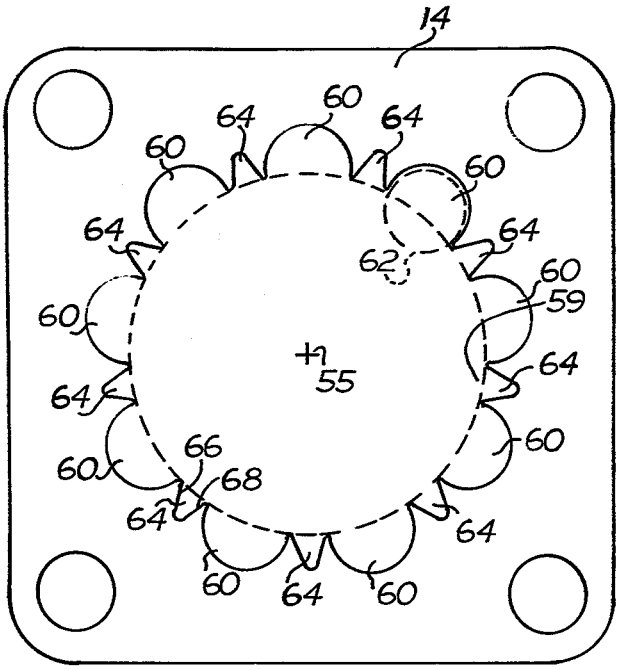
FIG. 2 is an axial view of the stator of the hydraulic device of FIG. 1.

The stator plate 14 has an internal bore having a central axis 55 (See FIG. 2). The stator plate 14 is preferably a one-piece homogeneous malleable cast iron metal member, with an inner wall 59 which is a continuous surface and which defines a series of circumferentially spaced arcuate recesses 60 which open into the internal bore. Each of the recesses 60 is an arcuate portion of a cylinder, and the centers of curvature of the recesses 60 are all equidistantly spaced from the central axis 55. Each arcuate recess 60 is dimensioned to receive a cylindrical roller 62 (only one is shown in FIG. 2). Each roller 62 is rollingly received by a respective recess with the rollers being circumferentially shiftable in their respective recesses in the manner disclosed in U.S. Pat. No. 3,289,602.

The recesses 60 are preferably slightly larger than semi-circular in circumferential extent so that they extend more than 180° around the roller and thus block expressive radial movement of the rollers 62. The inner wall of stator plate 14 with a cylindrical roller 62 being disposed in each of the recesses 60 forms the internally toothed stator of the gerotor gearset. As noted the rotor 54 has a plurality of external teeth (one less than the number of rollers 62 received by the stator plate 14). The spaces between the cylindrical rollers of the stator and the external teeth of the rotor define fluid pockets which expand and contract due to fluid pressures communicated thereto and by the relative rotational and orbital movement of the rotor and stator.

The inner wall 59 of the stator plate 14 also defines a plurality of circumferentially spaced notches 64 which are formed between the arcuate recesses 60 and which are radially disposed with respect to the central axis 55. The notches 64 extend axially completely through the stator plate 14, and thus intersect the opposite axial sides thereof. Each of the notches 64 is preferably defined by a pair of converging wall portions 66, 68 which converge at an angle of from 30° to 40° and have a radial depth which is slightly less than the depth of the recesses 60, as shown in FIG. 2. However, the angle and depth of the notches may vary within the purview of the principles of the present invention.

Figure 4:
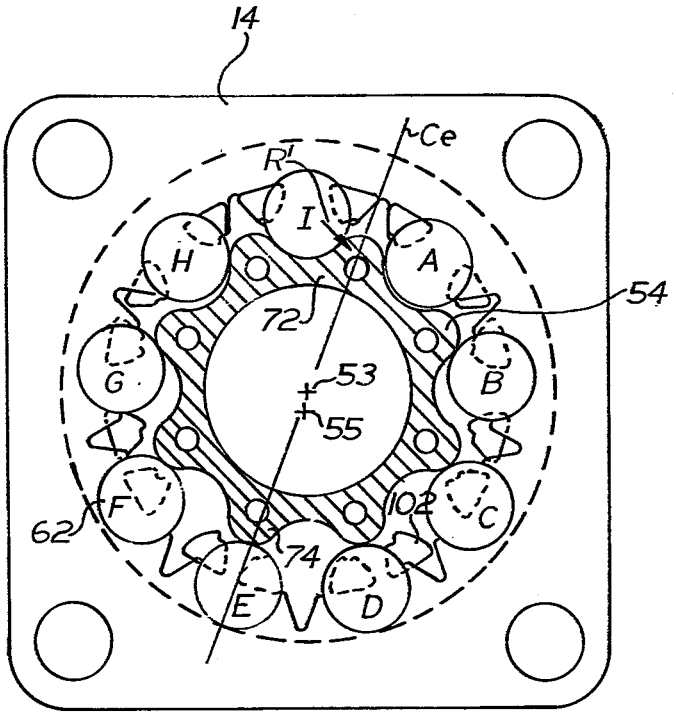
FIG. 4 is an axial view of the hydraulic device of FIG. 1, taken along the line X—X of FIG. 1, with portions omitted and illustrating a position of the gearset elements of the present invention different than their position in FIG. 1.

Referring to FIG. 4, a center of eccentricity of the device is defined by a line $C_e$ extending through the central axes of the rotor 54 and the stator. The commutation valve means, which are described more fully hereinafter, serves to direct high pressure fluid to the fluid pockets on one side of the line of eccentricity and to exhaust fluid from the fluid pockets on the other side of the line of eccentricity.

As shown in FIG. 4 the stator includes nine rollers lettered A through I, which rollers define the fluid pockets therebetween. At any given point the pockets on one side of the line of eccentricity (for example, the pockets between the roller vanes, I, H, G, F and E) are receiving high pressure fluid. The pockets on the other side of the line of eccentricity (for example, the pockets between rollers E, D C, B and A) are exhausting low pressure fluid. A resultant torque is exerted on the rotor 54 which torque causes the rotor to rotate about its center in a counter clockwise direction, and to orbit about the central axis 55 of the stator in a clockwise direction. At various points during this movement a rotor tooth may be at maximum insertion between teeth of the stator as shown by the rotor tooth 72 in FIG. 4. At other points during this motion a rotor tooth will be at minimum or no insertion between teeth of the stator (the tooth 74 in FIG. 4 is close to this position).

Figure 6:
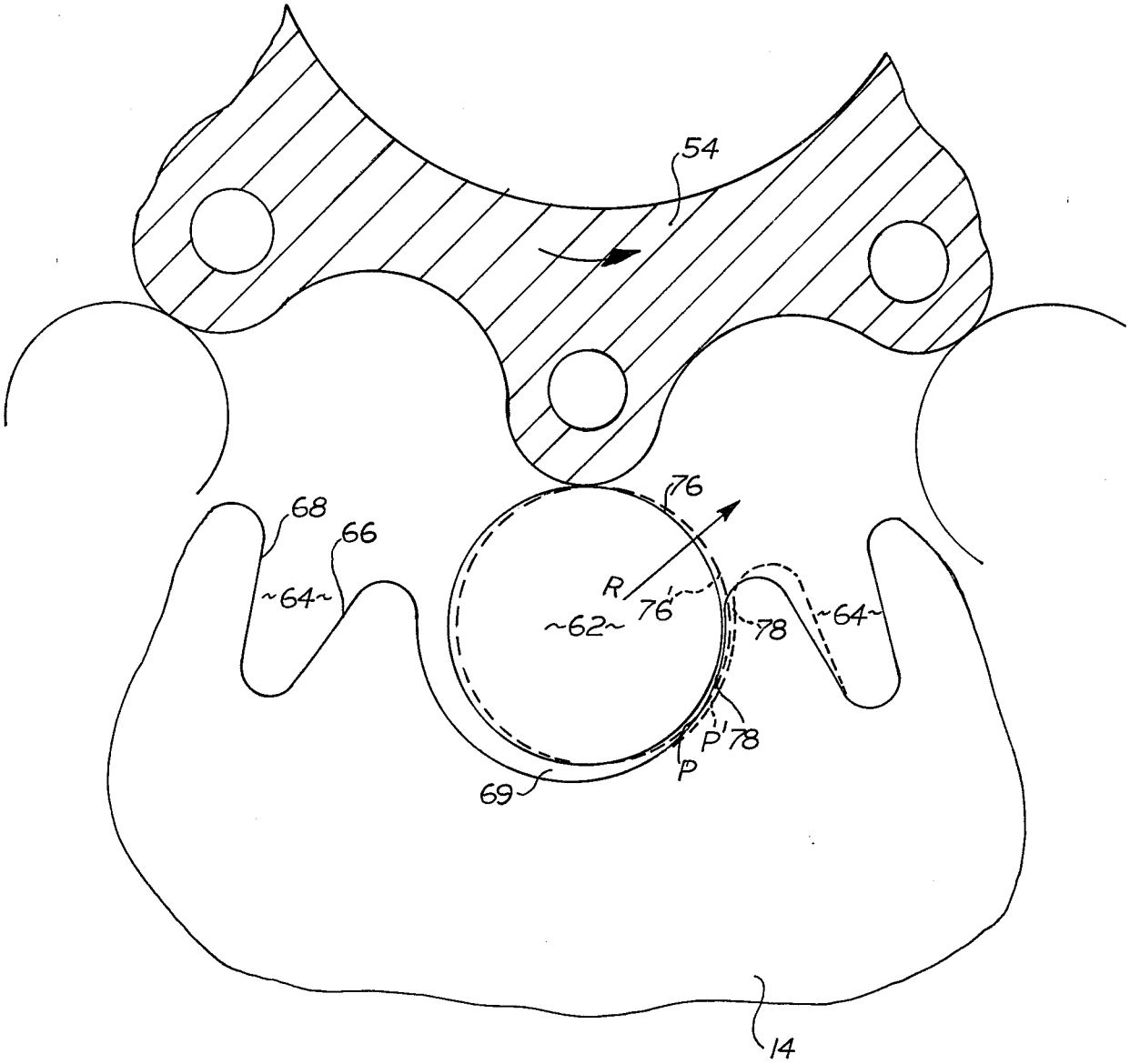
FIG. 6 is an enlarged schematic fragmentary representation of a gerotor gearset constructed according to the present invention and illustrating the manner in which the interengaging teeth react to the forces generated during operation of the gearset.

The provision of roller vanes which are rotatable and circumferentially shiftable in the recesses serves to seal the high pressure pockets from the low pressure pockets. Referring to FIG. 6 the rotor 54 is rotating counter clockwise when the high pressure fluid zone is on the left side of roller E and the low pressure fluid zone on the right side of roller E. Under such conditions a force is exerted on roller E tending to shift the roller E into tight sealing engagement with the right-hand portion of the recess wall. High pressure fluid has easy access to the radially outwardmost areas 69 of the recess. A resultant force R exerted on the roller exerts a substantial radially directed component against the roller E and urges the roller into tight sealing engagement with the tooth 74 of rotor 54. Referring to FIG. 4 the roller I (which is adjacent the rotor tooth 72 which is at maximum insertion) has a resultant force R′ exerted on it and it is also shifted both radially and circumferentially into sealing engagement with the rotor and with its respective recess to further seal the high pressure zone from the low pressure zone.

It is known that a small film of high pressure fluid tends to form between the rollers and the respective recess walls. FIG. 6 shows, in the full lines and in exaggerated scale, a small gap P between the outer wall 76 of the roller E and a portion 78 of the right side of the recess wall. A thin film of high pressure fluid forms in this gap and is not detrimental to the basic sealing function of the roller vanes, and in fact is useful in the sense that it serves to lubricate the rollers as they are rotated relative to the recess walls.

In prior art devices, at high pressures, in the absence of the notches 64 a roller such as E tends to be urged against a portion of its recess wall with such force that a fluid film cannot be maintained between the roller and the portion of the recess wall. This can cause extremely high direct frictional contact between the rollers and the recess wall and can result in extreme wear on the rollers and the recess walls. This would cause high wear on the rotor if forces between a roller and its respective recess wall became so high that the roller becomes locked against rotation.

The notches 64 enable the recess walls to be deflectable under forces which are generated during operation of the device. This reduces the possibility of direct contact occurring between the recess walls and the rollers. The notches 64 in the stator wall render portions of the recess walls resiliently deflectable under the effect of the forces which act on the stator teeth. In the illustration of FIG. 6 the deflected portion of the recess wall is shown in dashed lines at 78′, and the roller wall shifts into the position represented schematically at 76′. At high operating pressures the recess walls deflect as a function of the applied forces. Thus, as the recess walls deflect a fluid film can normally thereby be formed and maintained between the roller and the recess walls, thus minimizing the possibility of direct contact between the rollers and the recess walls and the roller maintains good sealing engagement and lubrication with the recess wall. When the high forces are reduced the resilience of the recess wall returns it to its original position.

If the high and low pressure zones were on the opposite sides of roller E than shown in FIG. 6, the rotor would be rotated clockwise. The roller E would shift circumferentially into engagement with the right-hand portion of the wall of the recess and the right side of the recess wall would deflect as a function of the applied forces.

Figure 5:
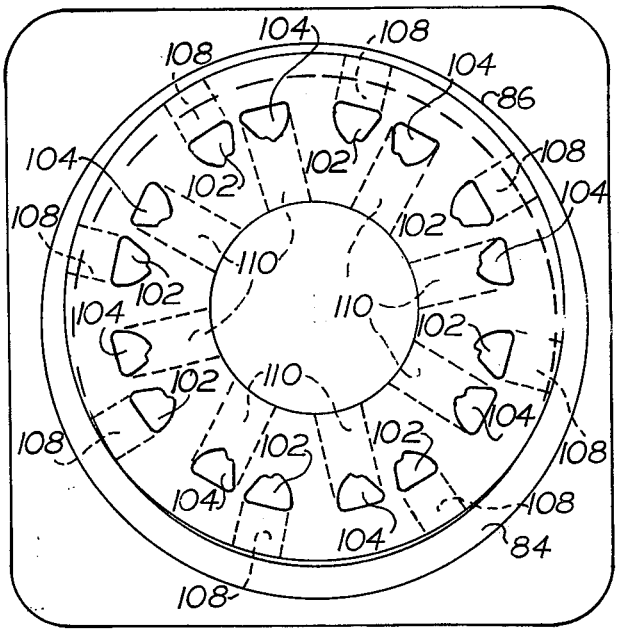
FIG. 5 is an axial view of the commutator plate of FIG. 4, with the rotor omitted.

The orbital and rotational movement of the rotor is generated by a fluid commutation system which is basically in FIGS. 1, 4 and 5. The fixed housing member 10 includes an annular channel 80. The annular channel 80 is in fluid communication (schematically illustrated at 82) with a first port (not shown) formed in the housing member. The first port communicates either high or low pressure fluid to the annular channel 80. The annular channel 80 is also in fluid communication with a fluid chamber 84 formed within an inner wall 86 of plate member 16.

A fluid passage 88 is also formed in the housing member 10. This passage is in fluid communication (schematically illustrated at 90) with a second port (not shown) in the housing member 10. The second port also functions as either a high or low pressure port. Fluid communicated to the passage 88 is in fluid communication with the spline connection between the wobble shaft 56 and the enlarged head 32 of the output shaft, with a central bore 92 formed in the wobble shaft, and thereby with a fluid chamber 94 within a central bore in a commutation plate 96.

Figure 3:
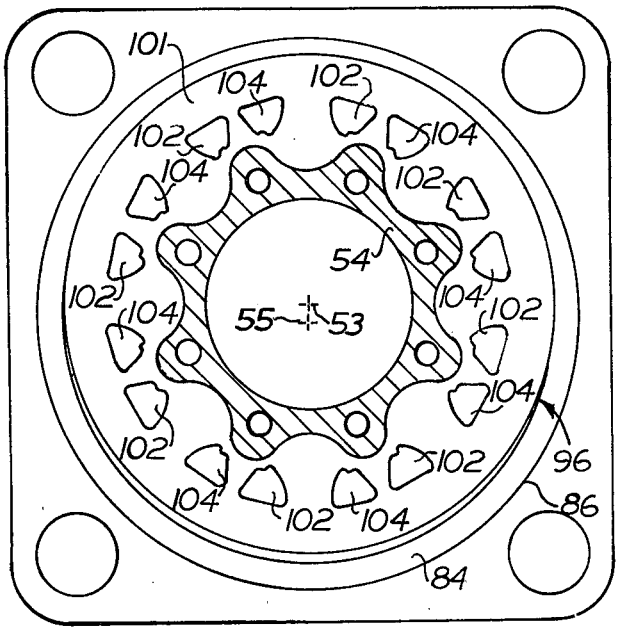
FIG. 3 is an axial view of the combined rotor and commutator plate of the device of FIG. 1, showing the rotor in section.

Commutation plate 96 is formed by three plates which are fixed to each other. The commutation plate 96 is fixed to the rotor (by pins 98) and orbits and rotates with the rotor. A first plate 100 has a radial face 101 which is in sliding engagement with one axial side of the stator plate 14 which forms part of the gerotor gearset. As seen in FIG. 3 plate 100 includes a plurality of pairs of first and second passages 102, 104 extending axially therethrough. The passages 102, 104 are arranged in a circular pattern.

A second plate 106 includes a plurality of pairs of generally radially extending first and second channels 108, 110 (see FIG. 5) with first channels 108 being disposed in fluid communication with respective first passages 102 and with chamber 84 (which encircles the commutation plate 96). The second channels 110 are disposed in fluid communication with respective second passages 104 and with fluid chamber 94 formed interiorly of the commutation plate. A third plate 112 acts as a wear plate which is in sliding engagement with a radial wall 114 of the housing member 10.

The fluid pockets formed by the hydraulic device of the present invention are formed between the rollers of the stator and include the notches 64 disposed between the rollers. In operation, high pressure fluid is directed through one port and is directed by either first passages 102 or second passages 104 to the fluid pockets on one side of the line of eccentricity. At the same time the other set of passages, 102 or 104 communicate the fluid pockets on the other side of the line of the eccentricity to the other port which is at low pressure. This generates the torque on the rotor and causes it to rotate and orbit with respect to the stator.

In a particularly advantageous feature of the present invention the circular pattern of the axial passages 102, 104 is dimensioned so that the axial passages 102, 104 are in radial alignment with the notches 64 in the stator in selected rotational and orbital positions of the members of the gerotor gearset. For example, as shown in FIG. 4, when a rotor tooth such as 74 is at minimum insertion little or none of the associated passages 102, 104 are in radial alignment with the notches 64. The passages associated with the tooth 72 at maximum insertion are both in radial alignment with the notches (though actual communication is blocked by wall portions of the stator). At various points between maximum and minimum insertion the amount of radial alignment of the passages 102, 104 with the notches varies.

In this manner fluid is effectively commutated against the notches and this provides for high volumetric efficiency. A pocket which is at high pressure and which is also approaching maximum insertion (e.g., the pocket between rollers G and H in FIG. 4) is in substantial communication with a first passage 102 so that high pressure fluid is substantially exhausted from the pocket before it undergoes transition from the low pressure zone to the high pressure zone. This minimizes high pressure drops in the pocket at maximum insertion. A fluid pocket at low pressure and which has just been subject to maximum insertion (e.g., the pocket between rollers A and B) is quickly exposed to a large portion of a second passage 104 to quickly communicate high pressure fluid to the pocket. This provides for substantial exhausting of the high pressure pockets prior to maximum insertion and substantial intake of fluid shortly after maximum insertion, and thereby avoids high pressure differentials in the pockets of maximum insertion, which condition would impair the volumetric efficiency of the device.

In addition, as seen in FIG. 5 each pair of the passages 102, 104 are shaped with adjacent walls which converge at the same angle as the walls of the notches. At maximum insertion the stator walls block communication of either passage with the pocket despite the radial alignment of the notches.

Also, as seen in FIG. 1 there is also provided a relief valve arrangement designed to exhaust fluid from the chamber 48 formed between insert member 22 and end closure member 26. A fluid passage 116 includes a first branch 118 communicating through a check valve 120 with the first port, and a second branch 122 which communicates through a check valve 124 with the second port. The arrangement is designed such that whichever port is at high pressure will close its respective check valve. Thus, high pressure fluid which leaks into chamber 48 can open the check valve leading to the low pressure port to exhaust the chamber 48.

While the foregoing description has illustrated the present invention in its preferred form it will be recognized by those of ordinary skill in the art that the principles of the present invention may be practiced with embodiments which represent obvious departures from the disclosed embodiment.

What is claimed is:

1. A hydraulic device comprising a gerotor gearset including first and second meshing gear members, said first gear member comprising an internally toothed member and said second gear member comprising an externally toothed member having one less tooth than said first gear member, said first and second gear members having relative orbital and rotational movement and defining a series of fluid pockets between their teeth which fluid pockets expand and contract upon relative orbital and rotational movement of the gear members, said internally toothed gear member having an inner wall defining a series of circumferentially spaced arcuate recesses, the teeth of said internally toothed member comprising cylindrical vane members located in said recesses and which are circumferentially and radially shiftable in the recesses under the influence of forces acting thereon, each cylindrical vane member being circumferentially shiftable into sealing engagement with a first portion of the surface defining the recess in which the vane member is located and radially shiftable into sealing engagement with a tooth on the externally toothed gear member to seal the pressure in the expanding pockets from the pressure in the contracting pockets when the cylindrical vane member is located between the expanding and contracting pockets, the cylindrical vane member and another portion of the surface defining the recess defining a fluid passage which is in fluid communication with an expanding or contracting pocket and which directs fluid in the expanding or contracting pocket around at least a portion of the cylindrical vane member and to a location which is radially outward of the cylindrical vane member, said inner wall of said internally toothed member further defining a series of circumferentially spaced notches corresponding in number to the number of arcuate recesses and with one notch disposed between each pair of adjacent arcuate recesses, and said first portion of the surface defining each recess being resiliently deflectable due to the forces applied to said first portion by the respective cylindrical vane members during operation of the device to thus enable a fluid film to be maintained between each of said cylindrical vane members and said first portion of the surface defining the recess.

2. A hydraulic device as defined in claim 1 wherein each of said notches includes wall surfaces which converge as they extend radially outwardly relative to said internally toothed member, said converging wall portions extending axially through said internally toothed member.

3. A hydraulic device as defined in claim 1 wherein said internally toothed member comprises a stator member having said inner wall, said stater member being fixed in said device and said externally toothed member being adapted for orbital and rotational movement relative to said internally toothed member, and further including commutation valve means for directing fluid into and from said pockets, said commutation valve means comprising a valve plate having a radial face abutting one axial side of said gerotor gearset, a series of pairs of fluid openings in said radial face of said valve plate, said pairs of fluid openings being disposed in a circular pattern, one of each of said pairs of fluid openings being in constant fluid communication with a first fluid chamber and the other of said pairs of fluid passages being in constant fluid communication with a second fluid chamber, said pairs of fluid openings being connected with said externally toothed member for orbital and rotational movement therewith to direct fluid to and from the expanding and contracting pockets in timed relation to the relative orbital and rotational movement of the externally toothed member, said fluid openings further being disposed so as to be in facing relationship with at least a portion of said notches as they direct fluid to and from the expanding and contracting pockets formed by the gearset.

4. A hydraulic device comprising a gerotor gearset including first and second meshing gear members, said first gear member comprising an internally toothed member and said second gear member comprising an externally toothed gear member having one less tooth than said first gear member, said first and second gear members having relative orbital and rotational movement and defining a series of pockets between their teeth which pockets expand and contract upon relative orbital and rotational movement of the gear members, said internally toothed gear member including a stator member having an inner wall with a series of circumferentially spaced arcuate recesses therein, the teeth of said internally toothed member comprising cylindrical vane members located in said recesses and which are circumferentially and radially shiftable in the recesses under the influence of forces acting thereon, each cylindrical vane member being circumferentially shiftable into sealing engagement with a portion of the surface defining the recess in which the vane member is located and radially shiftable into sealing engagement with a tooth of the externally toothed gear member to seal the expanding pockets from the contracting pockets when the cylindrical vane member is located between the expanding and contracting pockets, said stator member being fixed in said device and said externally toothed member having orbital and rotational movement relative to said internally toothed member, commutation valve means for directing fluid into and from said pockets, said commutation valve means comprising a valve plate having a radial face abutting one axial side of said gerotor gearset, a series of pairs of fluid openings in said radial face of said valve plate, said pairs of fluid openings being disposed in a circular pattern, one of each of said pairs of fluid openings being in constant fluid communication with a first fluid chamber and the other of said pairs of fluid passages being in constant fluid communication with a second fluid chamber, said pairs of fluid openings being connected with said externally toothed member for orbital and rotational movement therewith to direct fluid to and from the expanding and contracting pockets in timed relation to the relative orbital and rotational movement of the externally toothed member, said inner wall of said stator member further defining a series of circumferentially spaced notches corresponding in number to the number of arcuate recesses and with one notch disposed between each pair of adjacent arcuate recesses and defining a part of each pocket defined by said gear members, said fluid openings further being disposed so as to be in facing relationship and fluid communication with at least a portion of said notches as they direct fluid to and from the expanding and contracting pockets formed by the gearset.

5. A hydraulic device as defined in claim 4 wherein each of said spaced notches is defined by converging wall surfaces extending axially through said stator member.

6. A hydraulic device as defined in claim 5 wherein said stator member is made of malleable cast iron and said portion of the surface defining the recess against which each vane member seals is resiliently deflectable to enable a fluid film to be maintained between said portion and each vane when said seal is effected.

* * * * *